US005573239A

United States Patent [19]

Ryker et al.

[11] Patent Number: 5,573,239

[45] Date of Patent: Nov. 12, 1996

[54] APPARATUS TO CATCH, DETERMINE ACCURACY AND THROW BACK A BALL

[76] Inventors: Kenneth H. Ryker, 401 Kirkwood Ave., Stratford, N.J. 08084; Ronald D. Hawn, 1B Maynard Dr., Erial, N.J. 08081

[21] Appl. No.: 418,505

[22] Filed: Apr. 7, 1995

[51] Int. Cl.[6] ..... A63B 69/40

[52] U.S. Cl. ..... 273/26 A

[58] Field of Search ..... 273/26 R, 26 A

[56] References Cited

U.S. PATENT DOCUMENTS

| | | | |
|---|---|---|---|
| 2,040,228 | 5/1936 | Whiteley | 273/26 A |
| 2,384,235 | 9/1945 | Burnett | 280/52 |
| 2,657,931 | 11/1953 | Burrell | 273/26 A |
| 3,157,399 | 11/1964 | Gaudet | 273/26 A |
| 3,531,116 | 9/1970 | Trzesniewski | 273/26 R |
| 3,980,304 | 9/1976 | O'Neill et al. | 273/26 R |
| 4,199,141 | 4/1980 | Garcia | 273/26 A |
| 4,390,181 | 6/1983 | Parish | 273/26 A |
| 4,552,120 | 11/1985 | Nall et al. | 124/1 |
| 4,659,090 | 4/1987 | Kustanovich | 273/376 |
| 4,770,527 | 9/1988 | Park | 356/28 |
| 4,830,369 | 5/1989 | Poijras | 273/26 A |
| 4,858,922 | 8/1989 | Santavaci | 273/26 R |
| 4,978,121 | 12/1990 | Larkey | 273/26 A |
| 5,046,729 | 9/1991 | Yancey | 273/26 A |
| 5,133,548 | 7/1992 | Bedord et al. | 273/26 A |
| 5,222,731 | 6/1993 | Hanabusa et al. | 273/26 A |

FOREIGN PATENT DOCUMENTS 9012621 11/1990 WIPO .

*Primary Examiner*—William H. Grieb
*Attorney, Agent, or Firm*—Thomas A. Lennox

[57] ABSTRACT

An apparatus that determines the accuracy and speed of a thrown ball, catches the ball and throws the ball back to a source is provided that a housing with a front opening covered by tension adjustable vertical flexible strips with a ramp inclined downwardly to the front with a door closeable opening with a ball throwing device behind the ramp opening. Behind the strips is a hanging target pad with jiggle sensors on the pad and on the ramp sensing a ball hit, the sensors electrically connected to controller to record and display the count and the ball speed. A lever adjusts the distance between to spinning wheels of the ball return to adjust for ball size and pitching distance.

26 Claims, 5 Drawing Sheets

APPARATUS TO CATCH, DETERMINE ACCURACY AND THROW BACK A BALL

BACKGROUND OF THE INVENTION

This invention involves a device to catch and return pitched balls and recording the accuracy of the pitch.

A major obstacle to developing pitching techniques is that you need a catcher willing to spend the hours necessary for practice and development of the skills required to be a successful pitcher in baseball or softball games. Most successful pitchers have had a friend or relation that was willing to sacrifice the time necessary to develop the young arm. Without that help, development as a pitcher is severely hampered.

Even after the pitcher has developed a satisfactory technique, the coach of the pitcher's team wants to evaluate the pitcher's skill prior to allowing him to pitch for the team and to aid in the decision as to when the pitcher is ready to pitch during a game as a relief pitcher. Presently, the function of catching and returning the ball and of evaluating the speed and accuracy of the pitch is still up to personal observation. There is a great need for an apparatus to provide these functions.

Various devices have been described for tossing balls, recording accuracy, and the speed of pitches. U.S. Pat No. 4,552,120 to Nall, et al describes a batting instruction system throwing the ball from between a spinning tire and a track shifting the impeller toward or away from the track allowing for variation in ball sizes. In U.S. Pat. No. 5,133,548 to Bedord, et al, a pitching trainer with automatic ball return is described wherein the apparatus is a frame supporting a net enclosure with a target pad, a compression switch to register ball hits, and an inclined ramp on which a home plate indicia is imprinted. The device is equipped with a single wheel throw back mechanism. In U.S. Pat. No. 5,046,729 to Yancey, a baseball pitcher's practice target is described utilizing separate panels which, when hit, move rearwardly against springs to depress pressure switches to register hits on that panel. In U.S. Pat. No. 4,390,181 to Parish, a practice pitching apparatus is described utilizing resilient pads which move rearwardly upon impact of a ball against a spring to close push button contact switches to count and register balls and strikes. In U.S. Pat. No. 4,199,141 to Garcia, a baseball pitching scoring apparatus is described using panels which when hit with the ball move rearwardly against spring-loaded pins which close contact and register hits. In U.S. Pat. No. 2,040,228 to Whitley, a baseball pitching game device again registers hits by movement of a pad against a spring-loaded contact switch. In U.S. Pat. No. 3,157,399 to Gaudet, a baseball pitching practice target registers the location of a pitched ball by horizontal and vertical cords positioned in a grid across the target area. In International Application W090/12621 to Hall, a baseball batting apparatus utilizes a moving conveyor belt to move balls between wheels to project the balls to a batter. In U.S. Pat No. 4,978,121 to Larkey, a portable pitching practice system is described using flexible plastic or leather stripes (sic) which are moved aside by a thrown ball but offer escape resistance to a rebounding ball. In U.S. Pat. No. 3,980,304 to O'Neill, et al, a portable practice batting cage is provided utilizing a ball throwing machine. Carts with wheels and lifting handles are described in U.S. Pat. Nos. 1,161,256 and 2,384,235. In U.S. Pat. No. 4,858,922 to Santavaci, an apparatus for determining velocity and path of a ball is described using velocity sensing devices positioned at both sides of the apparatus directed inwardly to the housing. In U.S. Pat. No. 3,531,116 to Trzesneiwski, an electric baseball batting game is described using a photoelectric cell to register hits by the batter. In U.S. Pat. No. 4,770,527 to Park, a velocity and impact sensor is described using a grid of photo detectors detecting a ball passing through the array. In U.S. Pat. No. 4,659,090 to Kustanovich, a device for indicating force and location of target impacts uses a plurality of layers with a pressure sensitive layer between two electrode layers. In U.S. Pat. No. 2,657,931 to Burrell, a target baseball game is described using contact switches to register location of hits.

None of these devices satisfy the needs described above or attain the objects described herein below.

SUMMARY OF INVENTION

It is an object of the protection sought to provide an apparatus that receives a thrown ball, registers it as a strike or ball, and returns it to the pitcher.

It is a further object of the protection sought to provide an apparatus that receives pitched balls of varying sizes and essentially prevents them from bouncing out of the apparatus.

It is an additional object of the protection sought to provide an apparatus that allows easy adjustment of the sensitivity of impact sensors in order to accurate sensing of hits of the location of the hit.

It is an object of the protection sought to measure the velocity of the pitch and incorporate the mechanism in the above apparatus.

It is a further object of the protection sought to provide a throw back mechanism that allows easy and quick adjustment to varying ball size and varying distance to the pitcher.

It is an additional object of the protection sought to provide an integral apparatus that can be readily moved from one location to another by one person.

It is a particular object of the protection sought to provide an apparatus which can measure the performance of a pitcher and provide performance data to a person remote from the apparatus.

An aspect of the invention is an apparatus at which a ball is thrown to determine the accuracy of the throw, catches the ball and throws the ball back to a source. The apparatus includes a housing enclosing an inner chamber, the housing including a front opening bounded by a frame comprising side edges, an upper edge and a lower edge. The apparatus further includes a ramp inclined downwardly and frontwardly from the lower edge of the frame, the ramp including a front surface. The apparatus also includes a first opening through the front surface of the ramp, door closing means to alternatively open and close the first opening, and ball throwing means disposed rearwardly of the ramp to throw a ball out through the first opening when the door closing means is open. The apparatus further includes a shock absorbing pad of a shape to define a target hanging inside the chamber behind the front opening and first sensing means on the shock absorbing pad to sense a ball hitting said pad and close an electrical circuit each time said means senses a ball hit. The apparatus also includes apparatus sensing means on the apparatus to sense a ball hitting the apparatus at any location other than the shock absorbing pad and close an electrical circuit each time said means senses a ball hit. The apparatus further includes registering means to recognize the electrical circuit closures, record them, and display a record, and means to deliver a ball from the chamber to the ball throwing means.

A second aspect of the invention is an apparatus at which a ball is thrown to determine the accuracy of the throw. The apparatus includes a housing defining an inner chamber, the housing including a front opening bounded by a frame comprising side edges, an upper edge and a lower edge. The apparatus further includes a ramp inclined downwardly and frontwardly from the lower edge of the frame, the ramp including a front surface. The apparatus also includes a multiplicity of vertical strips of flexible material attached at upper ends of the strips to the upper edge of the frame and at lower ends of the strips to the lower edge of the frame. The apparatus further includes a shock absorbing pad of a shape to define a target hanging free inside the chamber behind the flexible strips and first sensing means on the shock absorbing pad to sense a ball hitting said pad comprising a contact member that responds to sudden movement in any direction caused by a ball hitting said pad by movement toward a second contact to close an electrical circuit. The apparatus also includes apparatus sensing means on the apparatus to sense a ball hitting the apparatus at any location other than the shock absorbing pad and close a second electrical circuit each time said means senses a ball hit. The apparatus further includes registering means to recognize the closing of the electrical circuits, record the closings, and display a record of the closings.

Yet another aspect of the invention is an apparatus at which a ball is thrown to determine the accuracy of the throw, to catch the ball and to throw the ball back to a source. The apparatus includes a housing enclosing an inner chamber, the housing comprising a front opening to receive a thrown ball, said opening bounded by a frame comprising side edges, an upper edge and a lower edge. The apparatus further includes a ramp inclined downwardly and frontwardly from the lower edge of the frame, the ramp comprising a front surface, a first opening through the front surface of the ramp, and door closing means to alternatively open and close the first opening. The apparatus also includes ball throwing means disposed rearwardly of the ramp to throw a ball out through the first opening when the door closing means is open. The ball throwing means includes a pair of rubber wheels comprising opposed surfaces rotating in opposite directions, two rotating means, one for each wheel, each on separate support members, to hold and rotate the wheels, movement means to move the two rotating means and the opposed rotating surfaces of the wheels alternatively closer together or farther apart, and lever means to move the movement means and to lock the movement means at a chosen position to fix a distance between the opposed rotating surfaces of the wheels. The apparatus further includes a target inside the chamber facing the front opening and sensing means to sense a ball hitting said target and originate an electrical signal each time said means senses a ball hit. The apparatus also includes registering means to recognize the electrical signal, record it, and display a record of ball hits, and means to deliver a ball from the chamber to the ball throwing means.

Yet another aspect of the invention is an apparatus at which a ball is thrown to determine the accuracy of the throw, catch the ball and throw the ball back to a source. The apparatus includes a housing defining an inner chamber, the housing comprising a front opening bounded by a frame comprising side edges, an upper edge and a lower edge. The apparatus further includes a ramp inclined downwardly and frontwardly from the lower edge of the frame, the ramp including a front surface, a first opening through the front surface of the ramp, and door means to alternatively open and close the first opening. The apparatus further includes ball throwing means disposed rearwardly of the ramp to throw a ball out through the first opening when the door means is open. The apparatus also includes a shock absorbing pad of a shape to define a target inside the chamber and first sensing means on the shock absorbing pad to sense a ball hitting said pad and close an electrical circuit each time said means senses a ball hit. The apparatus further includes registering means to recognize the electrical circuit closures, record them, and display a record, and means to deliver a ball from the chamber to the ball throwing means.

An additional aspect of the invention is an apparatus at which a ball is thrown to determine the accuracy of the throw, catch the ball and throw the ball back to a source. The apparatus includes a housing defining an inner chamber, the housing comprising a front opening to receive a thrown ball, the opening being bounded by a frame including side edges, an upper edge and a lower edge. The apparatus further includes a ramp inclined downwardly and frontwardly from the lower edge of the frame, the ramp including a front surface. The apparatus also includes ball throwing means to throw back a ball thrown through the front opening. The apparatus further includes a multiplicity of vertical strips of flexible material attached at upper ends of the strips to the upper edge of the frame and at lower ends of the strips to adjustment means to connect to the lower edge of the frame and allow tension adjustment on the strips. The apparatus also includes a shock absorbing pad of a shape to define a target hanging inside the chamber behind the flexible strips, first sensing means on the shock absorbing pad to sense a ball hitting said pad and close an electrical circuit each time said means senses a ball hit, registering means to recognize the electrical circuit closures, record them, and display a record, and means to deliver a ball from the chamber to the ball throwing means.

A further aspect of the invention is an apparatus at which a ball is thrown to determine the accuracy of the throw, catch the ball and throw the ball back to a source. The apparatus includes a housing defining an inner chamber, the housing comprising a front opening to receive a thrown ball, the frame being bounded by a frame comprising side edges, an upper edge and a lower edge. The apparatus further includes a ramp inclined downwardly and frontwardly from the lower edge of the frame, the ramp including a front surface. The apparatus also includes ball throwing means to throw back a ball thrown through the front opening. The apparatus further includes a shock absorbing pad of a shape to define a target hanging free inside the chamber behind the flexible strips and first sensing means on the shock absorbing pad to sense a ball hitting said pad and close an electrical circuit each time said means senses a ball hit, said means including a contact member that responds to sudden movement of the pad in any direction by movement toward a second contact to close the electrical circuit. The apparatus further includes apparatus sensing means on the apparatus to sense a ball hitting the apparatus at any location other than the shock absorbing pad and close an electrical circuit each time said means senses a ball hit, said means including a contact member that responds to sudden movement of the apparatus in any direction by movement toward a second contact to close the electrical circuit. The apparatus also includes registering means to recognize electrical circuit closures, record them, and display a record, and means to deliver a ball from the chamber to the ball throwing means.

This paragraph includes preferred embodiments that are used alone or in combination with any and all of the above aspects of the invention. It is preferred that the apparatus further include a third opening in the ramp and radar means to measure through the third opening a speed of a ball flying toward the front opening. It is preferred that the ball throwing means include a pair of rubber wheels including opposed surfaces rotating in opposite directions, two rotating means, one for each wheel, each on separate support members, to hold and rotate the wheels, movement means to move the two rotating means and the opposed rotating surfaces of the wheels alternatively closer together or farther apart, and lever means to move the movement means and to lock the movement means at a chosen position to fix a distance between the opposed rotating surfaces of the wheels. It is preferred that first sensing means include a contact member that responds to sudden movement in any direction of the sensing means by movement toward a second contact to close a circuit, the closing of which is recognizable by the registering means. It is preferred that the apparatus sensing means include second sensing means on the ramp to sense a ball hitting the ramp. It is preferred that the second sensing means include a contact member that responds to sudden movement in any direction of said sensing means by movement toward a second contact to close a circuit, the closing of which is recognizable by the registering means. It is preferred that the ramp be in physical contact with the frame and the second sensing means on the ramp also senses a ball hitting the frame. It is preferred that the apparatus further include at least one additional shock absorbing pad hanging inside the chamber behind the flexible strips, the pad being of a shape to define an area outside of the target area, and third sensing means on the additional shock absorbing pad to sense a ball hitting said pad. It is preferred that the apparatus further include a multiplicity of vertical strips of flexible material attached at upper ends of the strips to the upper edge of the frame and at lower ends of the strips to adjustment means to connect to the lower edge of the frame and allow tension adjustment on the strips. It is preferred that the apparatus further include adjustment means to connect the lower ends of the flexible strips to the lower edge of the frame and allow tension adjustment on the strips. It is preferred that the apparatus further include a first opening through the front surface of the ramp, door closing means to alternatively open and close the first opening, ball throwing means disposed rearwardly of the ramp to throw a ball out through the first opening when the door closing means is open, and means to deliver a ball from the chamber to the ball throwing means. It is preferred that the movement means include a horizontal rod rotatably supported and extending through a side wall of the housing, two pin members attached to and extending radially outwardly from the rod, and tie rod members each hingeably attached at one end to the pin members and at another end to respective motor support members, each of which support motors that are the rotating means and are hingeably supported to allow horizontal movement of the motor support members, wherein the lever means includes a lever member attached radially to an end of the rod outside the wall of the housing and rotation of the rod by movement of rod moves motor support members to move the opposed rotating surfaces of the wheels alternatively closer together or farther apart.

DESCRIPTION OF PREFERRED EMBODIMENTS

Figure 1:
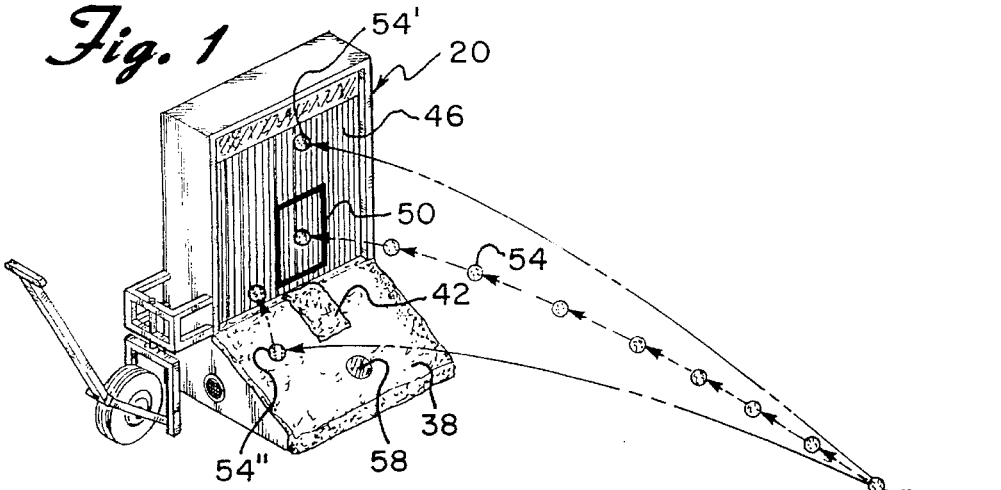
FIG. 1 is a front perspective view of an apparatus of the present invention being used by person throwing a ball at it.
Figure 2:
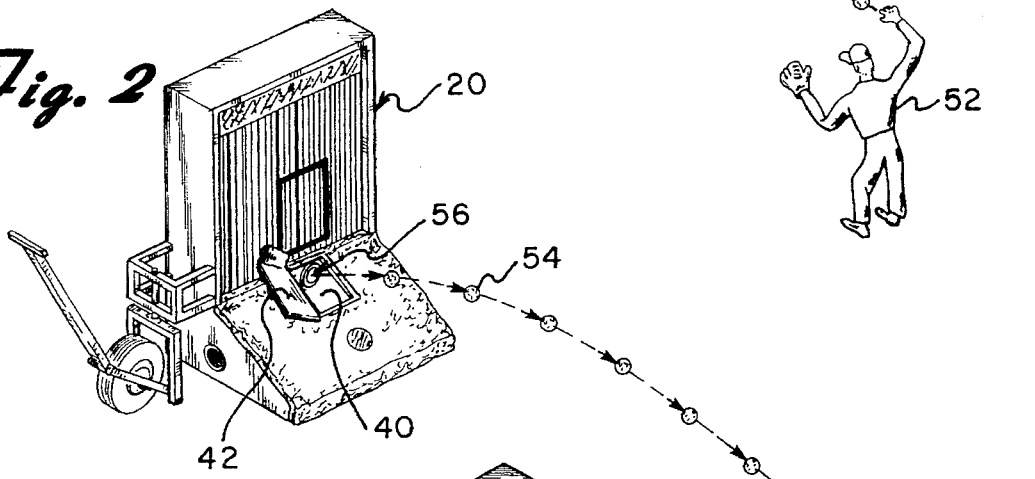
FIG. 2 is a is a front perspective view thereof showing the ball being thrown back by the apparatus.
Figure 3:
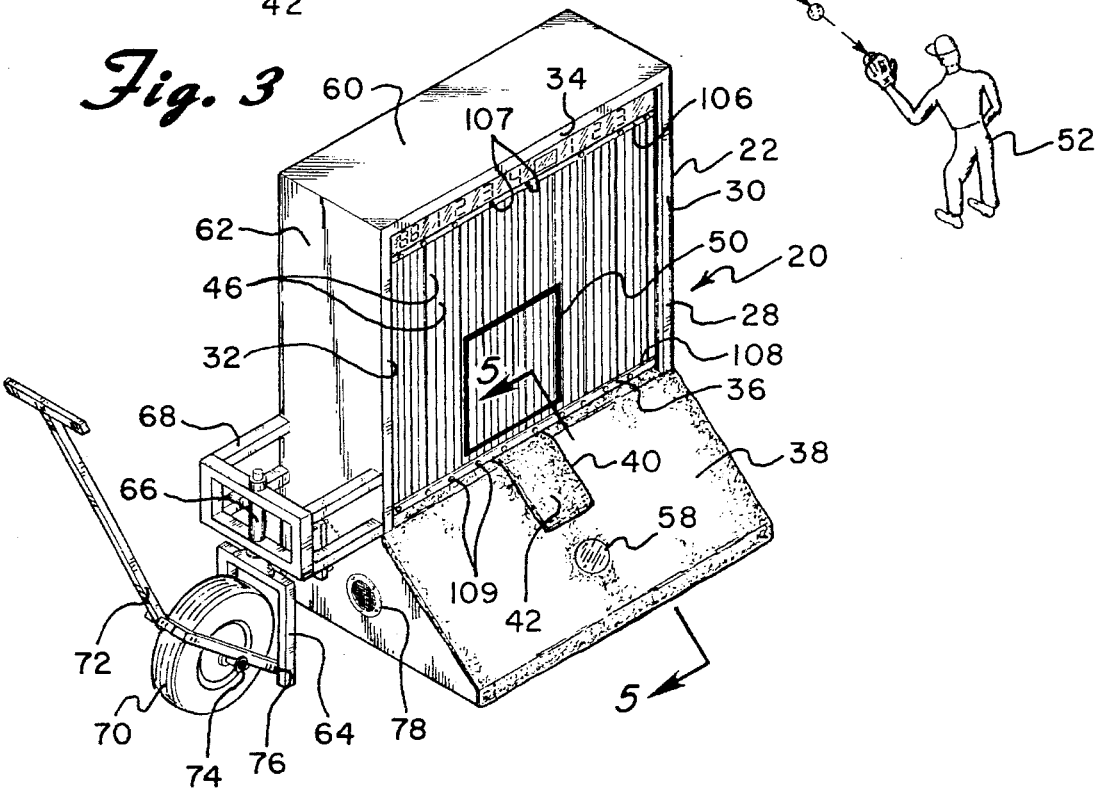
FIG. 3 is a is an enlarged front perspective view thereof.
Figure 5:
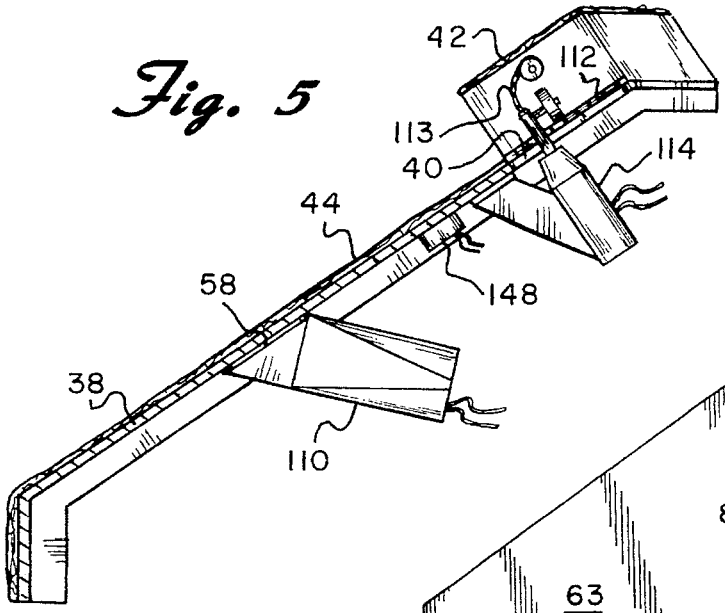
FIG. 5 is a is cross-sectional view taken along line 5—5 of FIG. 3.
Figure 7:
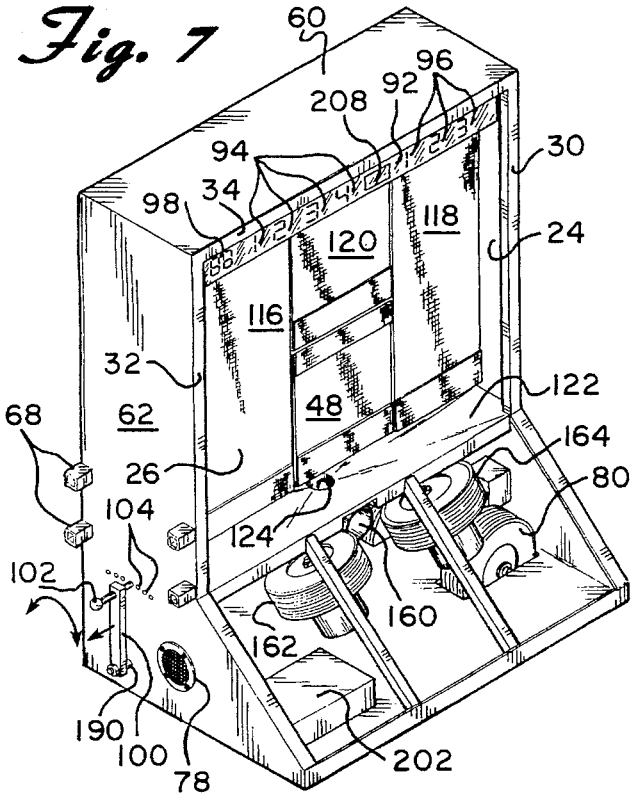
FIG. 7 is a is a front perspective view thereof as shown in FIG. 3 with the strips and ramp removed.
Figure 6:
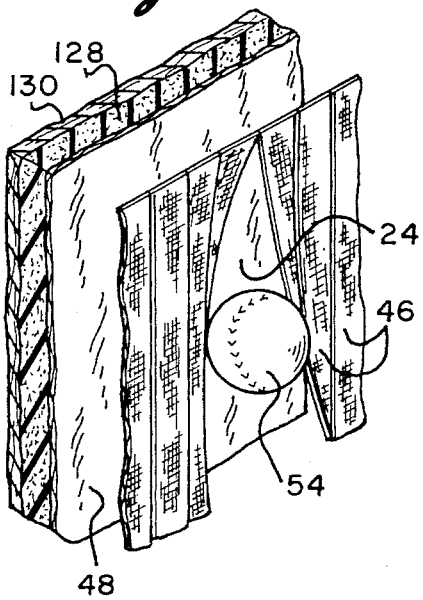
FIG. 6 is a is an enlarged partial cut away front perspective view from FIG. 1 showing the ball entry.

Device 20 is pictured in FIGS. 1 through 3. Smaller illustrations of device 20 are provided in FIGS. 1 and 2 showing the use of the device by pitcher 52 throwing ball 54 at the device. In FIG. 1, ball 54 is thrown accurately and impacts vertical strips 46 inside target imprint 50 which is printed on the vertical strips. This accurate throw is a strike and will be registered by device 20 as described herein below. Ball 54' is thrown too high, striking vertical strips 46 and entering front opening 26 of housing 22 at a height higher than target imprint 50. This throw will be registered a ball by the device. Ball 54" is thrown too low and to the left striking ramp 38 bouncing upwardly and through opening 26 into inner chamber 24 behind strips 46, which is shown in FIG. 7. This throw will also be registered a ball as will any ball striking the ramp or frame 28 surrounding front opening 26. Frame 28 as shown in FIG. 3 includes right side frame edge 30, left side frame edge 32, top frame edge 34 and lower frame edge 36. In the throwing and receiving stage of using device 20, door 42 on ramp 38 remains closed. A radar velocity measuring device aimed outwardly through transparent window 58 on ramp 38 measures the velocity of ball 54 as it approaches opening 26. As shown in FIG. 2, ball 54, having been received device 20 is returned to pitcher 52 by ball throwing means 56 through opening 40 exposed by open door 42. As shown in FIGS. 6 and 3, vertical flexible strips 46 are each attached at upper ends and lower ends to adjustment frame members 106 and 108, respectively. These horizontal frame members are adjustably attached to top frame edge 34 and lower frame edge 36, respectively with horizontally adjustable fasteners, to allow tension in the vertical flexible strips 46 to be adjusted. Vertical strips 46 are constructed of one eighth inch thick plastisized polyvinyl chloride film, preferably reinforced with fabric chosen to provide flexibility, durability, and memory retention. The strips are about one inch wide which allows the balls to penetrate through the vinyl strips pushing them aside and entering chamber 24 by passing between the strips. Vinyl strips 46 act as a trap to prevent the balls from bouncing back out of inner chamber 24. Balls passing through strips 46 contact the pads inside chamber 24 and sometimes bounce back. They are prevented from leaving the chamber by vinyl strips 46 and the ball drops down to the floor as will be shown in greater detail in FIG. 11. The tension on vinyl strips 46 sometimes needs to be adjusted to compensate for different size balls. Generally, tension is reduced as the size of the ball is increased to allow easier penetration through the strips while still preventing the balls from bouncing back out through the barrier. As illustrated in FIGS. 3 through 7, housing 22 is constructed of eighteen gauge steel sheet shaped, formed and attached at the corners with metal screws. Housing 22 includes top wall 60, left side wall 62, and right side wall 63 partially shown in FIG. 4. The upper portion of the housing is about four feet four inches high, sixty inches wide and about one foot eight inches deep. The sides are forty inches wide at the base and the housing is six feet two inches high. Ramp 38 extends upwardly to a height about one foot ten inches off the ground and is at an angle of about 30° to about 50°. This angle allows most balls striking front surface 44 of the ramp to careen upwardly through front opening 26 and into device 20 to be returned by ball throwing means 56. To move device 20 from place to place, a maneuvering device is attached to left side wall 62. Horizontal frame structure 68 extends outwardly from side wall 62. Vertical "Y" yoke frame member 64 is attached through vertical rotating connection 66 to horizontal frame 68. Wheel 70 rotating on axle 74 which is connected to a lower portion of lever handle 72, which in turn is connected at lower end 76 to the lower end of yoke member 64. With this mechanism, pulling down on lever handle 72 raises the left side of device 22 on wheel 70 so that it may be rolled on wheels 80 to a new location. Vent 78 is provided to allow a blower to air cool the electrical equipment inside the lower portion of housing 22. With handle 72 in the vertical unused position, the total width of device 20 is about six feet nine inches. When device 20 is at rest and in use, it rests on wheels 80 and two foot members located under the left side of housing 22. When the left side of device 20 is lifted using lever handle 72, device 20 is supported on wheel 70 and wheels 80 for movement.

Figure 4:
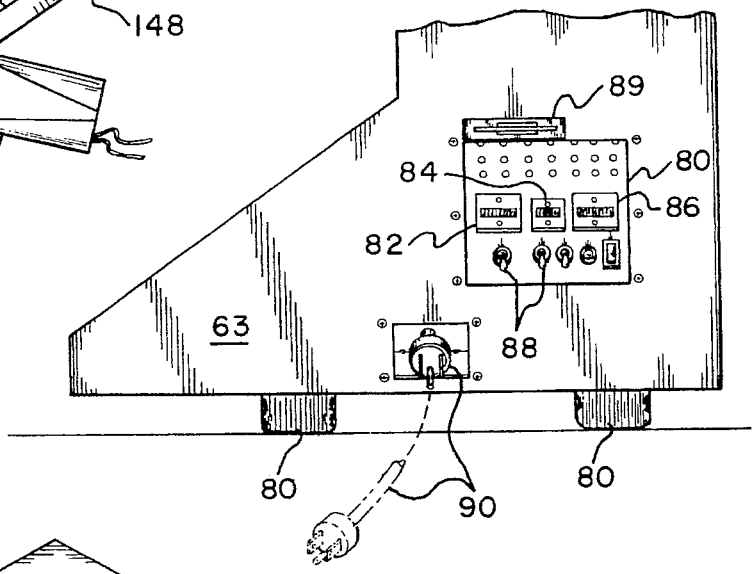
FIG. 4 is a is a partially cut off right side elevational view thereof.
Figure 8:
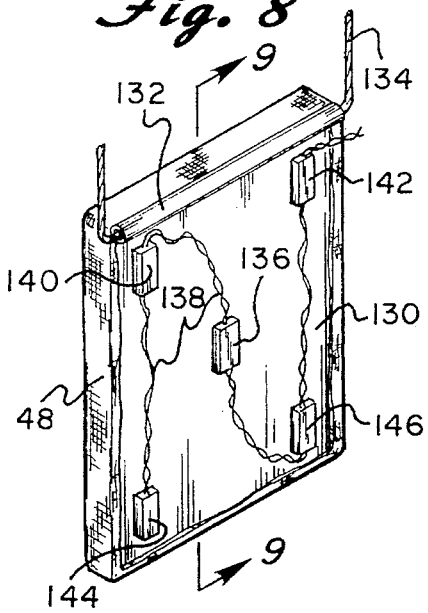
FIG. 8 is a is a rear perspective view of a hanging pad shown in FIG. 7.
Figure 9:
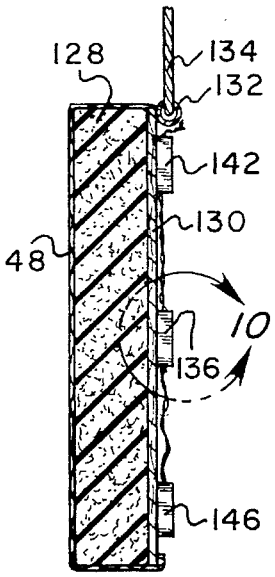
FIG. 9 is a is cross-sectional view taken along line 9—9 of FIG. 8.
Figure 10:
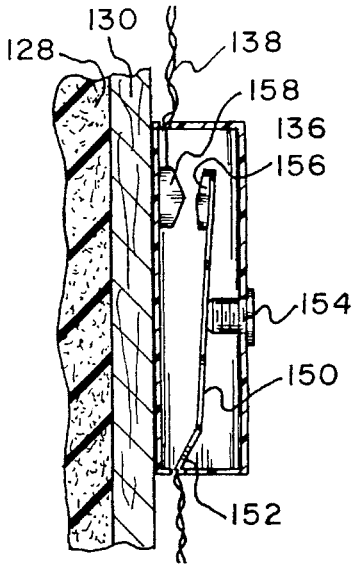
FIG. 10 is a is an enlarged cross-sectional view taken along line 10 of FIG. 9.
Figure 11:
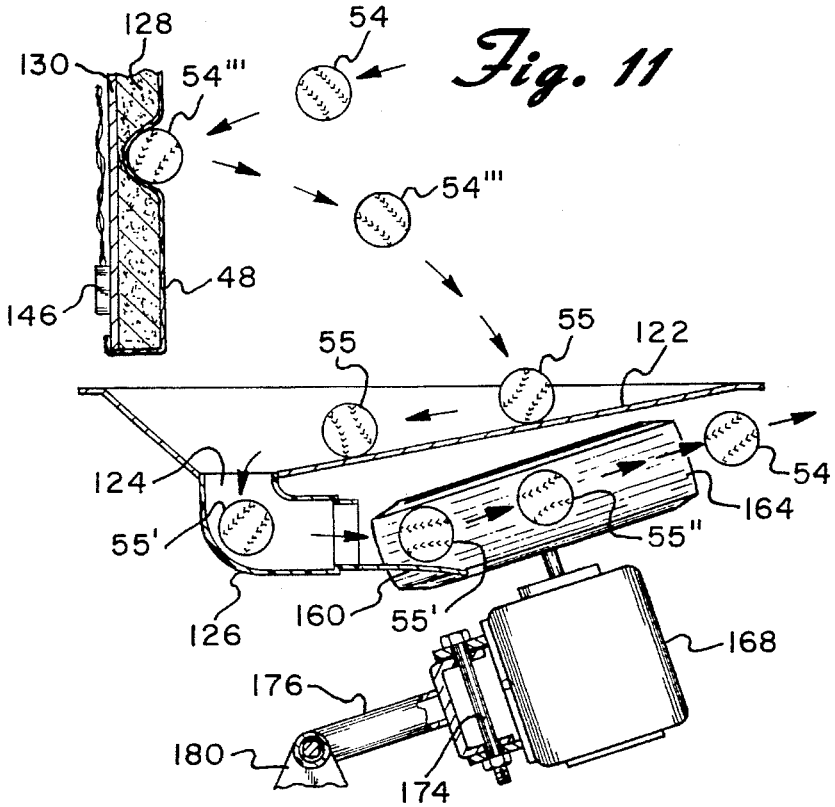
FIG. 11 is a is partial vertical schematic cross-sectional view of the ball return mechanism.

Display panel 92 is a piece of one eighth inch thick sheet of PLEXIGLAS® rigid clear acrylic sheet on which the numbers 94, one through four, to register the number of balls and numbers 96, one through three, to register the number of strikes, are printed. The acrylic sheet is in turn protected by a clear one eighth inch thick sheet of polyvinyl chloride sheet. Individual illuminated bulbs behind the respective numbers display the count. Radar display window 98 shows the velocity of ball 54 as measured by radar gun 110 is protected by display panel 92. As shown in FIG. 7, with the wheel moving mechanism cut away, handle 100 is shown which adjusts for varying sized balls, from baseball size to the largest of the softball sizes. Handle 100 is spring-loaded and is pulled out and adjusted, swinging right or left from the vertical, rotating one half inch diameter circular rod 190 which extends through wall 62 to the mechanism shown in FIGS. 12 and 13. The rotation position is set by engaging pin 106 in one of chosen holes 108. As shown in FIG. 4, the counters are connected through wall 63, including ball counter 82, strike counter 84, and total pitch counter 86. Individual breakers and switches 88 control the electric systems inside and power which is provided through retractable cord 90, which pulls out to a length of thirty feet. Wheels 80 support housing 22 about two inches above the ground. Ramp 38, as shown in the vertical cross sectional view of FIG. 5, is removable to provide entry to the mechanisms housed in the lower section of housing 22. Ramp 38 is constructed of one half inch thick plywood wrapped in aluminum to aid in causing low balls to carom upwardly through front opening 26 to be returned by the device. Radar gun 110, of a commercially available sports type, such as TRACER® or STALKER® guns, is attached under ramp 38 positioned to read ball speed through PLEXIGLAS® window 58. Door 42 is attached through hinge 112 to ramp 38 and is opened and closed with cable 113 by piston motor 114 which is a standard, commercially available, electrically operated door locking and unlocking device used in automobiles. When a ball is sensed in the return mechanism door 42 opens. As the ball is projected out of the machine back to the pitcher, door 42 automatically shuts once the ball leaves the machine. The striking pads inside chamber 24 are shown on FIGS. 6 through 11. Pad 48 is the target pad positioned behind strike target imprint 50. Left pad 116 hangs to the left of target pad 48 and extends from subfloor 122 up to top wall 60 and to left side wall 62. Balls striking pad 116 are registered a ball. Likewise, right pad 118 hangs to the right of target pad 48 extending from subfloor 122 up to top wall 60 and to the inside of right wall 63. Upper pad hangs above target pad 48 and between pads 116 and 118 extending from the top of target pad 48 to top wall 60. Pads 48, 116, 118, and 120 are all suspended by hangers similar to that illustrated in FIGS. 8 and 9 for target pad 148 and are separated from other pads and the walls. Target pad is sized to approximate the strike zone of a typical batter. As ball 54 is thrown at device 20 it is shown in FIG. 11 at positions 54''' striking target pad 48 and falling downwardly toward subfloor 122. The same ball, designated position 55, rolls down along inclined subfloor 122 toward return hole 124 entering tube 126 for return to the pitcher which will be described herein below. All of the pads are constructed of cloth covered flexible polymeric plastic foam 128 chosen to provide minimum elasticity. The flexible foam is about one and one quarter inch thick high density gym floor padding foam, and is chosen to deaden the impact of the ball striking the pad. Foam 128, held on three eighths inch plywood panel 130 by cloth covering 136, has a relatively slow rate of recovery to its original shape imparting little bounce to the ball striking the pad. Each of the pads hangs free and is separated from each other at their adjacent edges. Each pad is sensitive to movement and particularly to the strike of a ball. Each pad is equipped with at least one sensor, preferably a plurality, and more preferably a multiplicity of sensors. Target pad 48 as shown in FIG. 8 is equipped with five sensors, one at center and one proximate to each corner. Sensor 136 is positioned in the center, and is connected through wires 138 to an electronic controller. Likewise sensors 140, 142, 144, and 146 are positioned in the right upper corner, left upper corner, right lower, and left lower corner, respectively are also connected to the controller. While the sensors can be connected to read independently the respective location of the hit, they can also be connected in series to just register a strike. It is preferred that each sensor be connected independently so that it is possible to read, record, and display which sensor has registered a hit. For example, if the ball strikes pad 43 in the upper right hand corner, sensor 140 will register the hit indicating that it is a strike in that part of the zone. Each of the pads has at least one and, as shown in FIG. 14, preferably has a multiplicity of sensors all registering a ball and preferably registering where the ball hit on the pad. Sensors on pads 116, 138, and 120 are all balls. Further, any ball hitting pad 48, even though it also strikes a second pad, will register a strike overriding the hit outside the target area. Further, two sensors 148 are attached on the underside of ramp 38 in the upper right and left hand corners. A ball striking the ramp automatically is registered as a ball even if it caroms upwardly and strikes the target pad 48. Since ramp 38 is rigid and is in contact with frame 28, specifically the lower edges of right and left side frames and 30 and 32, these sensors pick up hits striking the frame also immediately registering a ball irrespective of a lucky bounce. All of the sensors are identical to sensor 136 illustrated in FIG. 10. Sensor 136 is a device known in the trade as a "jiggle" sensor used in burglar alarms systems to alert an attempt to open a window or door even before a breach has occurred. This type of sensor has been found to be extremely effective in this application as they can be easily adjusted to avoid misreading a hit and can be adjusted to provide varying degrees of sensitivity at different locations on a particular pad. Each sensor has weighted spring steel jiggle arm 150 which is connected to the case at connection 152. When arm 150 is at rest, it is against the end of adjustment screw 154 which is threadably connected to the case. Adjustment of screw 154 opens or closes the gap between weighted contact 156 on the end of arm 150 and second contact 158 to control sensitivity. When sensor 136 is moved or jiggled sufficiently, arm 150 tilts bringing contacts 156 and 158 together closing the circuit momentarily which is recognized and recorded as a hit. At rest, spring arm 150 returns to its position out of contact.

Figure 12:
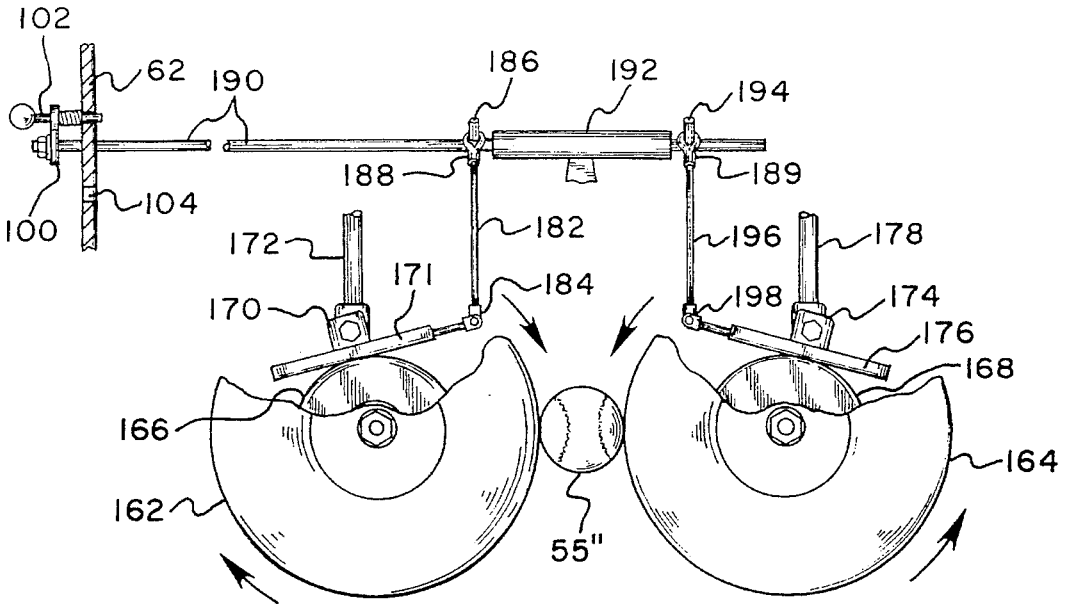
FIG. 12 is a is a horizontal cross-sectional view looking downwardly on the ball throw back mechanism.
Figure 13:
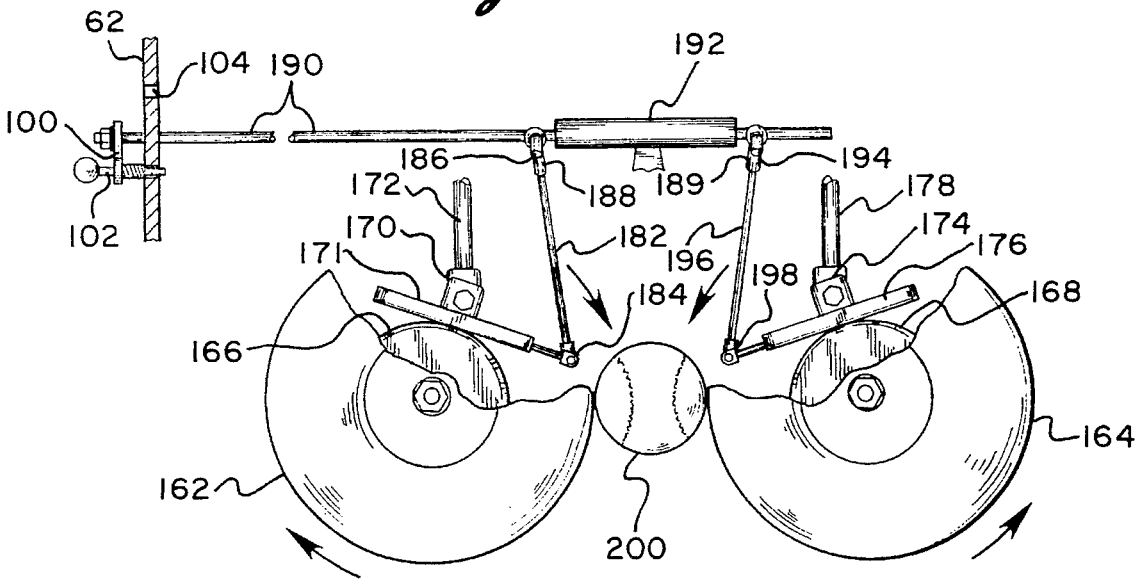
FIG. 13 is a is a horizontal cross-sectional view thereof with the mechanism adjusted for a larger ball diameter.
Figure 14:
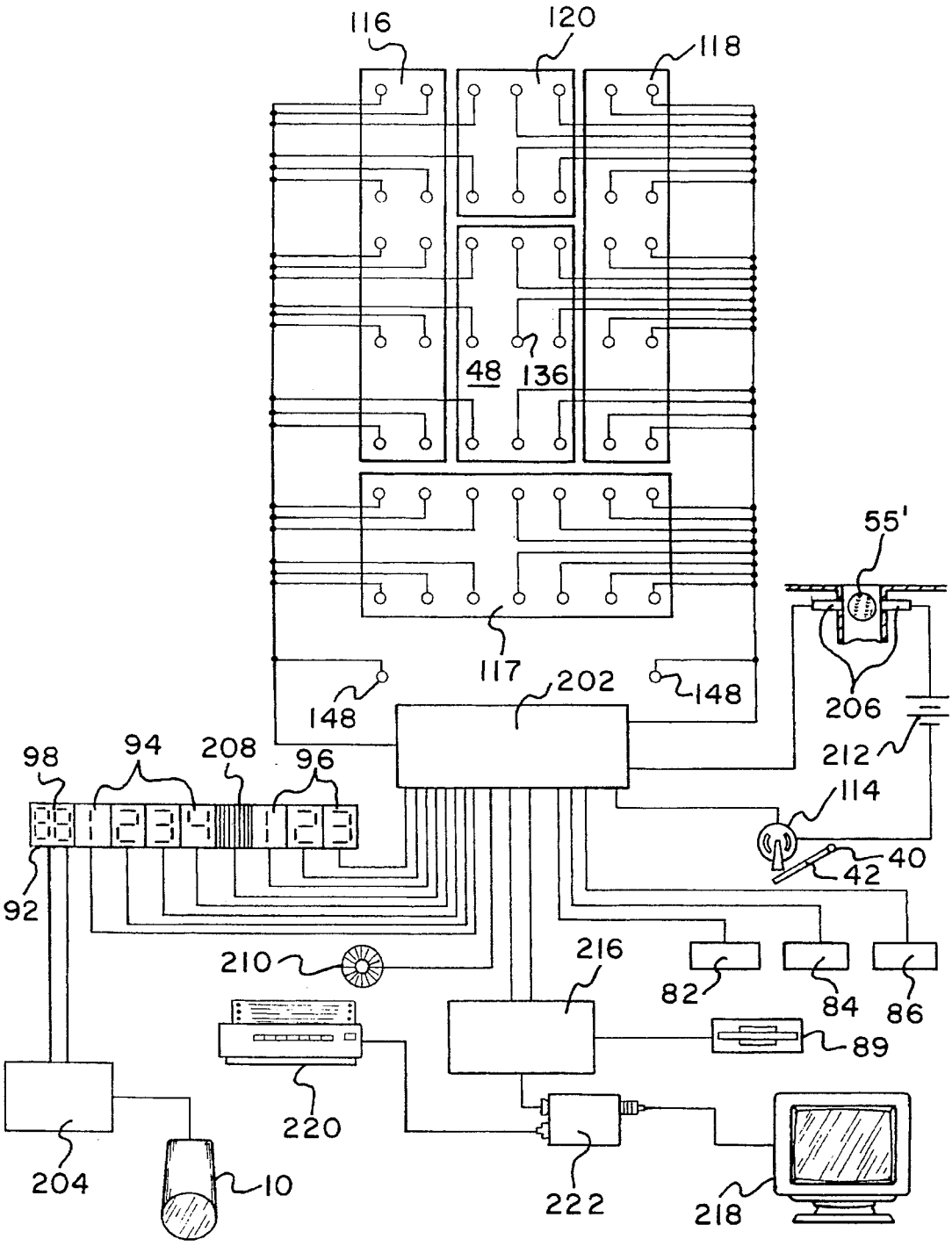
FIG. 14 is an electronic schematic of the registering mechanism, controlling mechanism, display mechanism, and recording mechanism.

The ball return mechanism is illustrated in FIGS. 7 and 11 through 13. After ball 55 enters hole 124 at position 55' into tube 126, it rolls down a slight incline onto trough 160 which curves downwardly as it extends between spinning eleven inch diameter air balloon slick tires 162 and 164 where it is grabbed between the spinning wheels at position 55" and projected back to the pitcher through opening 40. As shown in FIGS. 12 and 13, wheels 162 and 164 have caught ball 55" and are projecting it back to the pitcher. Wheel 162 is rotated clockwise by motor 166 with motor plate 171 pivotally connected at connection 170 to motor support member 172 which is in turn supported by motor base support 180 which rests on and is attached to the bottom floor of the device. Likewise, motor 166 spins wheel 164 counter-clockwise, and is attached to motor plate 171, which is supported on pivot connection 170 to motor support member 172 which connects to a motor support similar to that of support 180. Pivot connections 170 and 174 allow wheels 162 and 164 to be moved alternatively closer to each other or further apart.

The ball size adjustment mechanism includes tie rod 182 connected through pivot connection 184 to motor plate 171 at one end and through pivot connection 188 to pin 186 welded to and extending radially from horizontal rod 190. When rod 190 is rotated clockwise using handle 100 as shown in FIG. 13, motor 166 together with wheel 162 is moved laterally away from wheel 164. Similarly, tie rod 196 connects at one end through pivot connection 198 to motor plate 176 and at the other end through pivot connection 189 to pin 194, again extending radially out from rod 190. Rod 190 is supported by cylindrical tube 192 at one end and by wall 62 at the other end. As rod 190 is rotated clockwise, again as shown in FIG. 13, motor 168 and wheel 164 is moved laterally away from wheel 162, the space between the wheels being sufficient to accommodate larger softball 200. Adjustment for ball size is easily accomplished by pulling spring loaded pin 102 out of chosen hole 104 and rotating Rod 190 counterclockwise to pull wheels 162 and 164 closer together to accommodate smaller ball 55" as shown in FIG. 12. Most importantly, not only does the ball size control device adjust to handle ten, eleven, and twelve inch softballs and hardballs, it also adjusts the distance that the ball is projected back to the pitcher. Since the pitching distance varies from forty-five to ninety feet it is important to project the ball the appropriate distance. Choosing the appropriate hole 104 for pin 102, adjusts the distance between tires 162 and 164 and thus the pressure applied to the ball as it is seized between the spinning tires. Choosing a higher pressure chooses a harder and farther throw, thus allowing adjustment with arm 200 both the ball size and the pitching distance.

Control of device 20 is illustrated in FIG. 14 wherein a more preferred detailed schematic of pads 116, 118 and 120 is illustrated. Also shown as an alternate configuration is lower pad 117 positioned below the target strike zone of pad 48. A multiplicity of sensors are shown on each pad, each sensor being identical to that of sensor 136 described herein above. In this configuration, each sensor, including sensors 148 registering hits to the ramp or the frame of housing 22 are each connected independently to programmable, logic controller 202 which is programmed to control the functions of device 22 using commercially available well-known systems and hardware. Controller 202 is commercially available MITSUBISHI® mil sec FX 0–30 MR-ES controller. Radar gun 10 is controlled by radar controller 204 displaying the ball speed on two three inch tall LED's 98 for ten seconds followed by reset. When a ball strikes any of the pads, the closure of the sensor circuit is received and monitored by controller 202 which turns on the appropriate lamp behind display panel 92 registering a ball on lamp, or in the alternative, LED displays 94 and registering it in ball counter 82. A strike is displayed on lamp or LED 96 and recorded in counter 84. The total number of recorded hits are recorded in total counter 86. At the same time controller 202 displays the pitch, it opens ball return door 42 with motor 114. As ball 55 drops, rolls down slanted subfloor 122 and falls through hole 124 to position 55', it passes eye break beam light sensor 206 alerting controller 202 to turn on red warning light 208 which indicates that a ball is coming out of device 20. Buzzer 210 is activated at the same time as light 208 is flashing. Once ball 55 exits the machine, light 208 and buzzer 210 are turned off and controller 202 resets for the next pitch. If a ball enters device 20 without striking any sensor, the ball is detected by sensor 206 and door 42 is opened and flashing light 208 and buzzer 210 are activated until the ball exits the machine. The process of throwing balls at the apparatus continues until controller 202 displays three strikes or four balls at which time all displays are reset to zero to start a new series. Device 20 includes twelve volt battery power supply 212 to power door motor 114, counters 82, 84, and 86, radar controller 204 and throat sensor 206. Controller 202, data converter 214, PC controller 216, monitor 218, printer 220 and motors 166 and 168 all powered by 110 volt AC. The PC, data converter, printer, and monitor are all preferably external to device 20, and are protected by individual breakers that are not shown. A serial data signal is sent from sensors 136 to converter 214 that converts the data output from controller 202 to hexadecimal data that a standard PC unit 216 that interprets and writes to floppy disc drive 89. The disc can be taken from drive 89 and placed in PC unit 216 with appropriate software for display on monitor 218 and printing on printer 220 with a typical printout provided in Table 1. Interface cable 222, such as model RS 232, allows a coach to monitor the pitcher from a remote position on line, such as pitcher in the bullpen with the coach in the dugout.

TABLE I

| PITCHER: Ken Ryker | | | DATE: 6/6/95 | TIME: 11:50 AM | |
|---|---|---|---|---|---|
| | STRIKE | BALLS | SPEED | ZONE | RESULT |
| 1 | X | | 88 | UP/L | |
| 2 | X | | 89 | LO/R | |
| 3 | | X | 92 | UP/R | |
| 4 | X | | 87 | LO/R | S/OUT |
| 5 | | X | 75 | HI/R | |
| 6 | | X | 78 | HI/C | |
| 7 | X | | 89 | CEN | |
| 8 | | X | 95 | LO/R | |
| 9 | X | | 86 | CEN | |
| 10 | | X | 101 | UP/R | WALK |
| 11 | X | | 75 | LO/R | |
| 12 | X | | 78 | CEN | |
| 13 | X | | 77 | LO/R | S/OUT |

A machine of this invention is a pitching aid to be used by baseball and softball pitchers. The machine simulates pitching in a game situation. The pitcher throws from the proper distance from which they pitch for softball or hardball. When the pitcher throws the ball to the machine it catches the ball and a sequence of events occurs. The machine displays the speed of the pitch, and at the same time displays whether the pitch was a ball or a strike. At the same time, a warning light comes on along with a buzzer sounding warning the pitcher that the ball is being thrown back. This process continues after every pitch until the pitcher strikes out or walks the batter, when the machine automatically resets for the next batter. The machine records how many strikes and balls have been thrown by means of an electronic counter. Information can also be stored on a floppy disk drive connected to a programmable logical controller. This allows the pitcher to take the disk and insert it into a computer and print out the information showing his or her pitching statistics.

The material used for the cage housing 22 can be of a sheet metal, aluminum or fiberglass. A size of the cage is provided above, but is not limited to these measurements. Ramp 38 slopes forward out to the front at an angle of about 45 degrees. When a low pitch is thrown to the machine, the ball will deflect up and still be caught by the machine.

In order to move the cage it has two main wheels 80 that protrude out the bottom. These balloon air tires with an outside diameter of 12 inches or less. The third tire 70 is mounted on the opposite end of the cage and is mounted to a steerable handle. In order to move the machine, you push down on the handle and the tire is used as a fulcrum to lift the machine and move it easily. The inside of the back of the cage is lined with foam padding to reduce the sound from the ball hitting the metal or fiberglass walls. The foam pad are upholstered and have a hem at the top of the pad. a 5/16 steel rod is inserted through the hem and is supported to the top of the cage.

Strips 46 are tension adjusted by bolts 107 which pass through elongated horizontal holes of frame member 106. An alternative tensioning device is attachment of the bottom of the vinyl strips 46 to a metal angle member. The vinyl is attached to a vertical edge with the other angle held horizontally. Vertical bolts through the horizontal side pull the angle member and the vinyl downwardly toward frame 36. After the ball hits the pads, the ball falls to a subfloor 122 constructed from a mold using fiberglass cloth and resin or molded rubber. The floor has a front to back pitch of two inches and side to middle of two inches. A four inch hole 124 allows the ball to fall through to a 90 degree pipe 126 where it hits switch 206 that alerts controller 202 that the ball is about to be thrown back to the pitcher. This 90 degree pipe also has an adjustment thumb screw. When the ball 55' comes to the throat, it is pinched between the two spinning tires set ¾ of an inch less than the diameter of the ball being thrown.

While this invention has been described with reference to specific embodiments disclosed herein, it is not confined to the details set forth and the patent is intended to include modifications and changes which may come within and extend from the following claims.

We claim:

1. An apparatus at which a ball is thrown to determine the accuracy of the throw, catch the ball and throw the ball back to a source, the apparatus comprising:

(a) a housing enclosing an inner chamber, the housing comprising a front opening bounded by a frame comprising side edges, an upper edge and a lower edge, (b) a ramp inclined downwardly and frontwardly from the lower edge of the frame, the ramp comprising a front surface, (c) a first opening through the front surface of the ramp, (d) door means to alternatively open and close the first opening, (e) ball throwing means disposed rearwardly of the ramp to throw a ball out through the first opening when the door closing means is open, (f) a shock absorbing pad of a shape to define a target hanging inside the chamber behind the front opening, (g) first sensing means on the shock absorbing pad to sense a ball hitting said pad and close an electrical circuit each time said means senses a ball hit, (h) apparatus sensing means on the apparatus to sense a ball hitting the apparatus at any location other than the shock absorbing pad and close an electrical circuit each time said means senses a ball hit, (i) registering means to recognize the electrical circuit closures, record them, and display a record, and (j) means to deliver a ball from the chamber to the ball throwing means.

2. The apparatus of claim 1 further comprising a second opening in the ramp and radar means to measure through the third opening a speed of a ball flying toward the front opening.

3. The apparatus of claim 1 wherein the ball throwing means comprises:

(i) a pair of rubber wheels comprising opposed surfaces rotating in opposite directions, (ii) two rotating means, one for each wheel, each on separate support members, to hold and rotate the wheels, (iii) movement means to move the two rotating means and the opposed rotating surfaces of the wheels alternatively closer together or farther apart, and (iv) lever means to move the movement means and to lock the movement means at a chosen position to fix a distance between the opposed rotating surfaces of the wheels.

4. The apparatus of claim 1 wherein the first sensing means comprises a contact member that responds to sudden movement in any direction of the sensing means by movement toward a second contact to close a circuit, the closing of which is recognizable by the registering means.

5. The apparatus of claim 1 wherein the apparatus sensing means comprises second sensing means on the ramp to sense a ball hitting the ramp.

6. The apparatus of claim 5 wherein the second sensing means comprises a contact member that responds to sudden movement in any direction of said sensing means by movement toward a second contact to close a circuit, the closing of which is recognizable by the registering means.

7. The apparatus of claim 5 wherein the ramp is in physical contact with the frame and the second sensing means on the ramp also senses a ball hitting the frame.

8. The apparatus of claim 1 further comprising at least one additional shock absorbing pad hanging inside the chamber adjacent to the front opening, the pad being of a shape to define an area outside of the target area, and third sensing means on the additional shock absorbing pad to sense a ball hitting said pad.

9. The apparatus of claim 1 further comprising:

(a) a multiplicity of vertical strips of flexible material comprising:
  (i) upper ends of the strips attached to the upper edge of the frame, and
  (ii) lower ends of the strips, and (b) adjustment means to connect the lower ends to the lower edge of the frame and allow tension adjustment on the strips.

10. An apparatus at which a ball is thrown to determine the accuracy of the throw, the apparatus comprising:

(a) a housing enclosing an inner chamber, the housing comprising a front opening bounded by a frame comprising side edges, an upper edge and a lower edge, (b) a ramp inclined downwardly and frontwardly from the lower edge of the frame, the ramp comprising a front surface, (c) a multiplicity of vertical strips of flexible material comprising:
  (i) upper ends of the strips attached to the upper edge of the frame, and
  (ii) lower ends of the strips, and (d) adjustment means to connect the lower ends to the lower edge of the frame and allow tension adjustment on the strips, (e) a shock absorbing pad of a shape to define a target hanging free inside the chamber behind the flexible strips, (f) sensing means on the shock absorbing pad to sense a ball hitting said pad comprising a first contact member that responds to sudden movement in any direction caused by a ball hitting said pad by movement toward a first contact, (g) a first electrical circuit that is closed when the first contact member touches the first contact, (h) apparatus sensing means on the apparatus to sense a ball hitting the apparatus at any location other than the shock absorbing pad, said means comprising a second contact member that responds to sudden movement in any direction caused by a ball hitting said any location by movement toward a second contact, (i) a second electrical circuit that is closed when the second contact member touches the second contact each time said means senses a ball hit, and (j) registering means to recognize the closing of the electrical circuits, record the closings, and display a record of the closings.

11. The apparatus of claim 10 wherein the apparatus sensing means comprises second sensing means on the ramp to sense a ball hitting the ramp.

12. The apparatus of claim 11 wherein the ramp is in physical contact with the frame and the second sensing means on the ramp also senses a ball hitting the frame.

13. The apparatus of claim 10 further comprising at least one additional shock absorbing pad hanging inside the chamber behind the flexible strips, the pad being of a shape to define an area outside of the target area, and third sensing means on the additional shock absorbing pad to sense a ball hitting said pad.

14. The apparatus of claim 10 further comprising adjustment means to connect the lower ends of the flexible strips to the lower edge of the frame and allow tension adjustment on the strips.

15. The apparatus of claim 10 further comprising:

(a) a first opening through the front surface of the ramp, (b) door means to alternatively open and close the first opening, (c) ball throwing means disposed rearwardly of the ramp to throw a ball out through the first opening when the door closing means is open, and (d) means to deliver a ball from the chamber to the ball throwing means.

16. The apparatus of claim 15 further comprising a second opening in the ramp and radar means to measure through the second opening a speed of a ball flying toward the front opening.

17. The apparatus of claim 15 wherein the ball throwing means comprises:

(i) a pair of rubber wheels comprising opposed surfaces rotating in opposite directions, (ii) two rotating means, one for each wheel, each on separate support members, to hold and rotate the wheels, (iii) movement means to move the two rotating means and the opposed rotating surfaces of the wheels alternatively closer together or farther apart, and (iv) lever means to move the movement means and to lock the movement means at a chosen position to fix a distance between the opposed rotating surfaces of the wheels.

18. An apparatus at which a ball is thrown to determine the accuracy of the throw, to catch the ball and to throw the ball back to a source, the apparatus comprising:

(a) a housing enclosing an inner chamber, the housing comprising a front opening to receive a thrown ball, said opening bounded by a frame comprising side edges, an upper edge and a lower edge, (b) a ramp inclined downwardly and frontwardly from the lower edge of the frame, the ramp comprising a front surface, (c) a first opening through the front surface of the ramp, (d) door means to alternatively open and close the first opening, (e) ball throwing means disposed rearwardly of the ramp to throw a ball out through the first opening when the door closing means is open, the ball throwing means comprising:
  (i) a pair of rubber wheels comprising opposed surfaces rotating in opposite directions,
  (ii) two rotating means, one for each wheel, each on separate support members, to hold and rotate the wheels,
  (iii) movement means to move the two rotating means and the opposed rotating surfaces of the wheels alternatively closer together or farther apart, and
  (iv) lever means to move the movement means and to lock the movement means at a chosen position to fix a distance between the opposed rotating surfaces of the wheels, (f) a target inside the chamber facing the front opening, (g) sensing means to sense a ball hitting said target and originate an electrical signal each time said means senses a ball hit, (h) registering means to recognize the electrical signal, record it, and display a record of ball hits, and (i) means to deliver a ball from the chamber to the ball throwing means.

19. The apparatus of claim 18 further comprising a second opening in the ramp and radar means to measure through said opening a speed of a ball flying toward the front opening.

20. The apparatus of claim 18 further comprising:

(a) a multiplicity of vertical strips of flexible material comprising:

(i) upper ends of the strips attached to the upper edge of the frame, and (ii) lower ends of the strips, and (b) adjustment means to connect the lower ends to the lower edge of the frame and allow tension adjustment on the strips.

21. The apparatus of claim 18 wherein the target comprises a shock absorbing pad of a shape to define the target hanging inside the chamber facing the front opening, and the sensing means comprises first sensing means on the shock absorbing pad to sense a ball hitting said pad and originate an electrical signal each time said means senses a ball hit.

22. The apparatus of claim 21 further comprising apparatus sensing means on the apparatus to sense a ball hitting the apparatus at any location other than the shock absorbing pad and originate an electrical signal each time said means senses a ball hit.

23. The apparatus of claim 18 wherein the movement means comprises:

(i) a horizontal rod rotatably supported and extending through a side wall of the housing, (ii) two pin members attached to and extending radially outwardly from the rod, and (iii) tie rod members each hingeably attached at one end to the pin members and at another end to respective motor support members, each of which support motors that are the rotating means and are hingeably supported to allow horizontal movement of the motor support members, wherein the lever means comprises a lever member attached radially to an end of the rod outside the wall of the housing and rotation of the rod by movement of rod moves motor support members to move the opposed rotating surfaces of the wheels alternatively closer together or farther apart.

24. An apparatus at which a ball is thrown to determine the accuracy of the throw, catch the ball and throw the ball back to a source, the apparatus comprising:

(a) a housing defining an inner chamber, the housing comprising a front opening bounded by a frame comprising side edges, an upper edge and a lower edge, (b) a ramp inclined downwardly and frontwardly from the lower edge of the frame, the ramp comprising a front surface, (c) an opening through the front surface of the ramp, (d) door means to alternatively open and close the first opening, (e) ball throwing means disposed rearwardly of the ramp to throw a ball out through the first opening when the door means is open, (f) a shock absorbing pad of a shape to define a target inside the chamber, (g) an electrical circuit, (h) sensing means on the shock absorbing pad to sense a ball hitting said pad and close the electrical circuit each time said means senses a ball hit, (i) registering means to recognize any electrical circuit closures, record them, and display a record, and (j) means to deliver a ball from the chamber to the ball throwing means.

25. An apparatus at which a ball is thrown to determine the accuracy of the throw, catch the ball and throw the ball back to a source, the apparatus comprising:

(a) a housing defining an inner chamber, the housing comprising a front opening to receive a thrown ball, the opening being bounded by a frame comprising side edges, an upper edge and a lower edge, (b) a ramp inclined downwardly and frontwardly from the lower edge of the frame, the ramp comprising a front surface, (c) ball throwing means to throw back a ball thrown through the front opening, (d) a multiplicity of vertical strips of flexible material comprising:

(i) upper ends of the strips attached to the upper edge of the frame, and (ii) lower ends of the strips, and (e) adjustment means to connect the lower ends to the lower edge of the frame and allow tension adjustment on the strips, (f) a shock absorbing pad of a shape to define a target hanging inside the chamber behind the flexible strips, (g) an electrical circuit, (h) sensing means on the shock absorbing pad to sense a ball hitting said pad and close the electrical circuit each time said means senses a ball hit, (i) registering means to recognize any electrical circuit closures, record them, and display a record, and (j) means to deliver a ball from the chamber to the ball throwing means.

26. An apparatus at which a ball is thrown to determine the accuracy of the throw, catch the ball and throw the ball back to a source, the apparatus comprising:

(a) a housing defining an inner chamber, the housing comprising a front opening to receive a thrown ball, the frame being bounded by a frame comprising side edges, an upper edge and a lower edge, (b) a ramp inclined downwardly and frontwardly from the lower edge of the frame, the ramp comprising a front surface, (c) ball throwing means to throw back a ball thrown through the front opening, (d) a shock absorbing pad of a shape to define a target hanging free inside the chamber behind the flexible strips, (e) sensing means on the shock absorbing pad to sense a ball hitting said pad, said means comprising a first contact member that responds to sudden movement of the pad in any direction by movement toward a first contact, (f) a first electrical circuit that is closed when the first contact member touches the first contact, (g) apparatus sensing means on the apparatus to sense a ball hitting the apparatus at any location other than the shock absorbing pad, said means comprising a contact member that responds to sudden movement of the apparatus in any direction by movement toward a second contact, (h) a second electrical circuit that is closed when the second contact member touches the second contact each time said apparatus sensing means senses a ball hit, (i) registering means to recognize electrical circuit closures, record them, and display a record, and (j) means to deliver a ball from the chamber to the ball throwing means.

* * * * *